United States Patent [19]

Tsubota et al.

[11] 4,084,072

[45] Apr. 11, 1978

[54] PRESSURE DIFFERENTIAL SWITCH DEVICE

[75] Inventors: Haruo Tsubota, Toyota; Katsuki Takayama; Naoji Sakakibara, both of Chiryu; Nobuyuki Hashimoto, Toyota, all of Japan

[73] Assignee: Aisin Seiki Kabushiki Kaisha, Kariya, Japan

[21] Appl. No.: 685,772

[22] Filed: May 12, 1976

[30] Foreign Application Priority Data

May 21, 1975 Japan ..... 50-60497
May 23, 1975 Japan ..... 50-62150

[51] Int. Cl.[2] ..... H01H 35/34

[52] U.S. Cl. ..... 200/83 L; 200/83 S; 73/716

[58] Field of Search ..... 335/205; 340/240; 73/407 R; 200/83 S, 83 A, 83 L, 84 C

[56] References Cited

U.S. PATENT DOCUMENTS

| | | | |
|---|---|---|---|
| 3,007,017 | 10/1961 | Dwyer | 200/83 A |
| 3,551,620 | 12/1970 | Hoover | 200/83 L |
| 3,654,956 | 4/1972 | Tsubouchi | 200/84 C |
| 3,678,232 | 7/1972 | Hodges | 200/84 C |
| 3,680,044 | 7/1972 | Tsubouchi | 200/84 C |
| 3,786,211 | 1/1974 | Popp | 200/83 L |
| 3,946,175 | 3/1976 | Sitabkhan | 200/83 L |

*Primary Examiner*—Gerald P. Tolin
*Attorney, Agent, or Firm*—Burns, Doane, Swecker & Mathis

[57] ABSTRACT

A pressure differential switch device having a flexible diaphragm between two chambers subject to differential pressures and a permanent magnet movable with the diaphragm against a biasing force when pressure differences occur in the chambers; the magnet moving to a position in which the magnetic field of the magnet actuates the contacts of a reed switch assembly.

5 Claims, 5 Drawing Figures

PRESSURE DIFFERENTIAL SWITCH DEVICE

BACKGROUND OF THE INVENTION

Pressure switches are known having snap action diaphragms for mechanically actuating the contacts of a switch. However, such switches are usually actuated by rather high pressures which are necessary to cause the diaphragm to snap from one position to another and furthermore when it is desired to alter the critical pressure at which the diaphragm will snap it is necessary to replace the diaphragm in the pressure switch.

SUMMARY OF PRESENT INVENTION

According to the present invention a flexible diaphragm movable in response to differential pressures in two chambers facing opposed sides of the diaphragm against a biasing force, is employed and a permanent magnet, movable with the diaphragm, is provided for actuating a reed switch when moved to a position in which the magnetic field of the magnet acts on the contacts of the reed switch. The biasing force may be altered for varying the differential pressure at which the magnet will be moved. The pressure responsive switch of the present invention is more compact, less expensive to manufacture and more reliable than the prior pressure switch.

Figure 1:
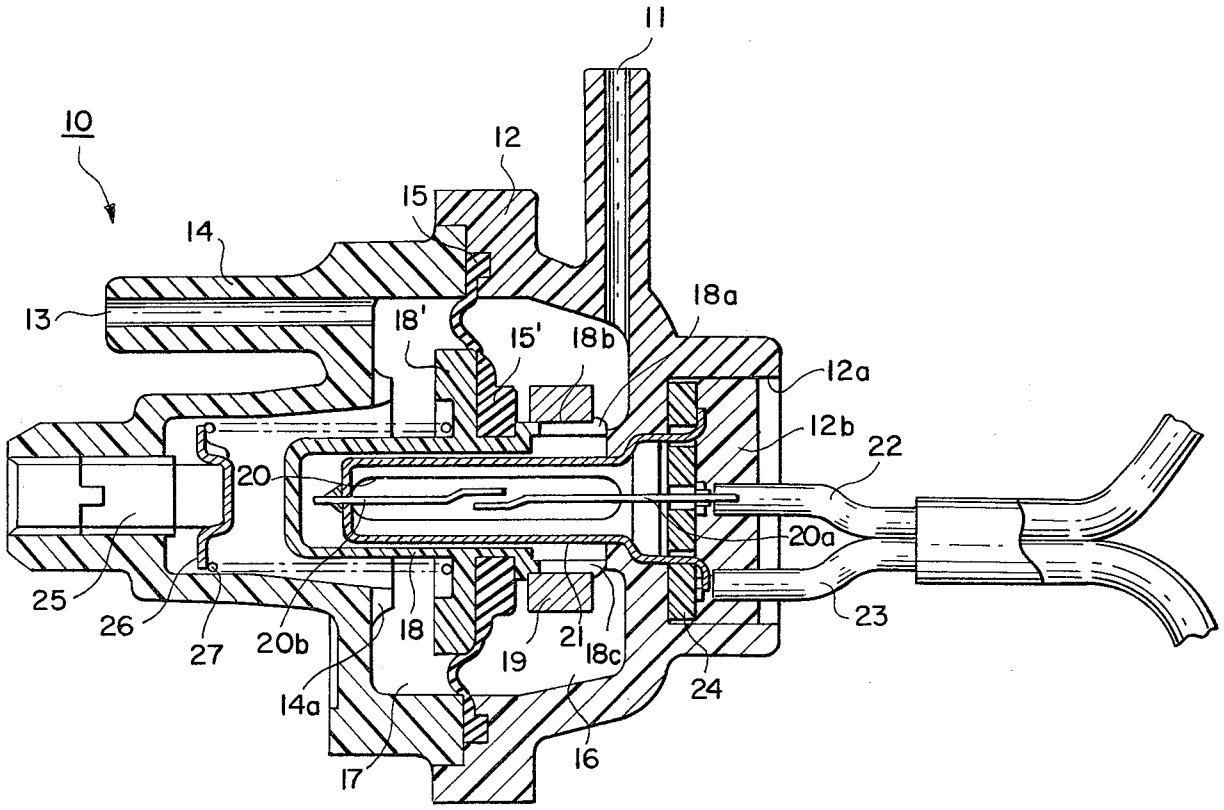
FIG. 1 is a cross-sectional view of a first embodiment of the invention.
Figure 2:
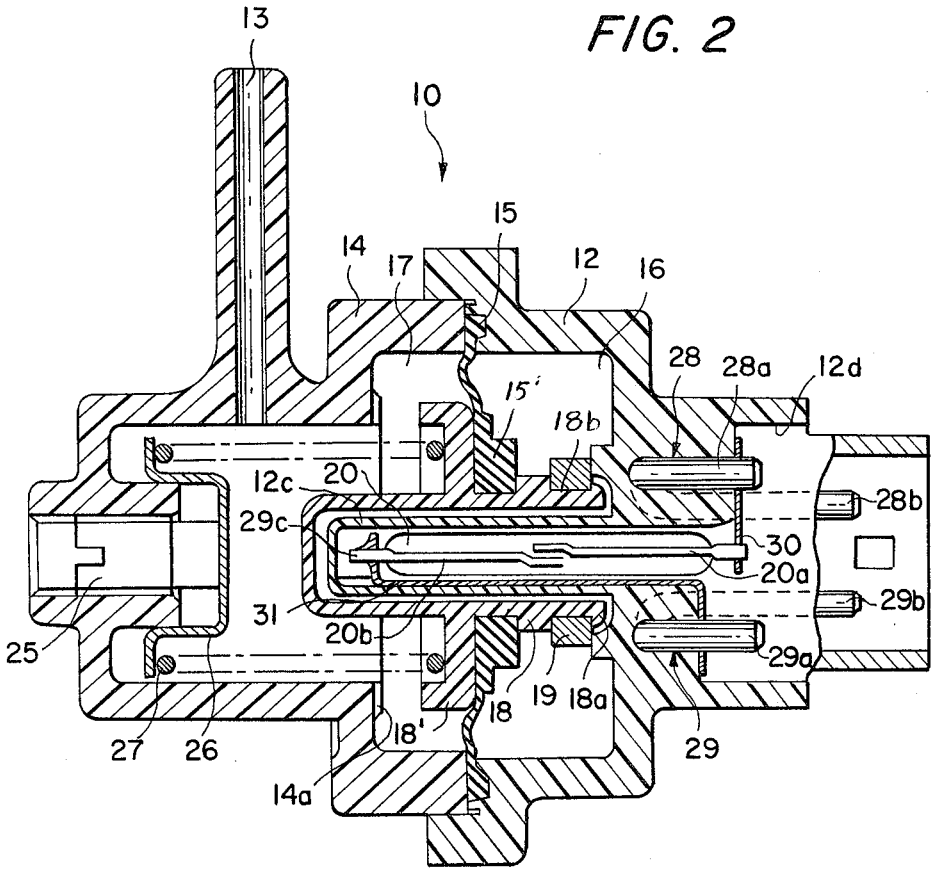
FIG. 2 is a cross-sectional view of a second embodiment of the invention taken along line II—II of FIG. 4.

According to FIG. 1, a pressure differential switch device 10 is shown having two casing members 12 and 14 formed of a non-conductive material such as synthetic resin. The outer periphery of a resilient ring-shaped diaphragm 15 formed of elastic material such as rubber or the like is secured to members 12 and 14 by way of ultrasonic deposition or the like, so that the inner periphery of the diaphragm 15 projects radially inwardly thereby to create a movable, inner portion 15'. A movable cylindrical member 18 having a flange 18' is located at its middle portion, and to which the inner periphery of diaphragm 15 is secured. Thus, the two casing members 12 and 14 define two compartments 16 and 17 which are hermetically sealed from one another by the diaphragm 15 and by the cylindrical member 18. Ports 11 and 13 communicate with the interior of the compartments 16 and 17 respectively, and serve as inlets to admit fluid pressure thereinto. The cylindrical member 18 is formed of non-conductive material such as a synthetic resin.

A permanent annular magnet 19 is disposed in an annular recess **18*b* provided on the outer peripheral surface to the right of the flange 18'. The right hand end of the cylindrical member 18 is also provided with a plurality of slots 18*c* to give flexibility thereto so that the magnet ring 19 may be easily slipped from right to left into recess 18*b* to be secured therein. The right end surface 18*a* of the member 18 engages with the inner surface of the casing member 12 serving as a stop when no pressure difference prevails between the two compartments 16 and 17 as shown in FIG. 1**.

The switch device 10 further includes a reed switch assembly 20 which is disposed in a capsule 21 within the cylindrical member 18. The capsule 21 is formed of conductive metal plate and the right end thereof is secured to a non-conductive plate 24 which is provided within a recessed portion **12*a* of the member 12 and is secured therein by a synthetic resin filler 12*b*. The ends of lead wires 22 and 23 are also mounted in the hollow portion 12*a* and are connected respectively with contact 20*a* of the switch assembly 20 and with the right end of the capsule 21. The contact 20*b* of switch assembly 20 is connected to the left end of the capsule 21, so that the contact 20*b* is electrically connected with the lead wire 23 through the conductive metal capsule 21. Numeral 27 shows a biasing spring disposed between the flange 18' of the member 18 and a retainer 26 which is adjustable by a screw 25. The diaphragm 15 as well as the member 18 is normally biased toward the right by the spring 27 as shown in FIG. 1**.

OPERATION OF FIRST EMBODIMENT

When the pressure in the compartment 17 is reduced or the pressure in the compartment 16 is increased, the pressure difference between the two compartments 16 and 17 will cause the diaphragm 15 as well as the member 18 and magnet 19 to be moved to the left by overcoming the biasing force of spring 27. Such pressure difference reaches a predetermined value which is determined by the force of spring 27, and the magnet 19 when moved to the left, provides a magnetic field around the contacts **20*a*, 20*b* such that they are pushed into contact with each other to close the switch and establish a circuit through the lead wires 22, 23. If the pressure difference further continues, the flange 18' of the member 18 engages with an inner stop surface 14*a* of the member 14** to prevent an undesirable opening of the circuit.

In the second embodiment of the switch device as shown in FIGS. 2 to 5, similar elements serving similar functions have the same reference numerals as shown in FIG. 1.

Instead of the capsule 21 of FIG. 1, the member 12 is provided with a hollow projection **12*c* which extends inwardly to the left from the inner surface thereof. The hollow projection 12*c* receives the reed switch assembly 20**.

A pair of U-shaped connectors 28 and 29 are securely mounted in the member 12 as shown. Both ends of each connector are exposed in the recessed portion **12*d* of the member 12. One exposed end 28*a* of connector 18 is connected with one contact 20*a* of the switch assembly 20 via a plate 30 while one end 29*a* of the connector 29 is connected at 29*c* with the other contact 20*b* of the switch assembly 20 via a plate 31. It should be noted that all elements 28, 29, 30, 31** are made of conductive metal material.

Figure 5:
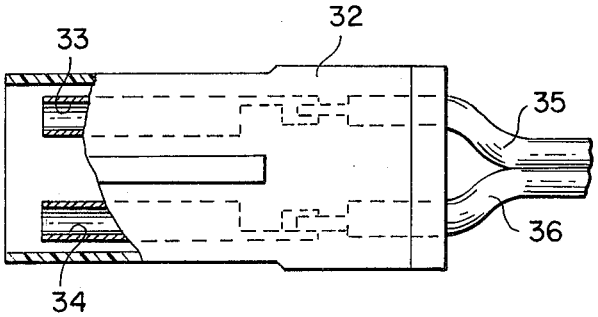
FIG. 5 is an elevational view, partly broken away, of a connecter used with the second embodiment.
Figure 3:
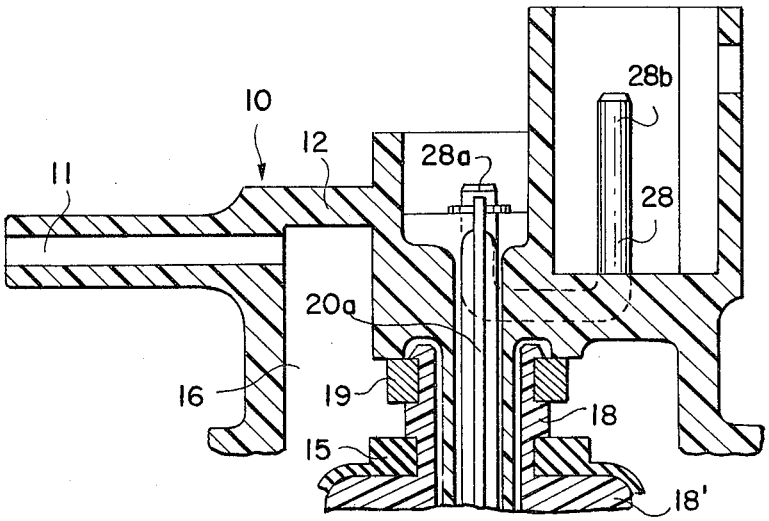
FIG. 3 is a partial cross-sectional view taken along the line III—III of FIG. 4.
Figure 4:
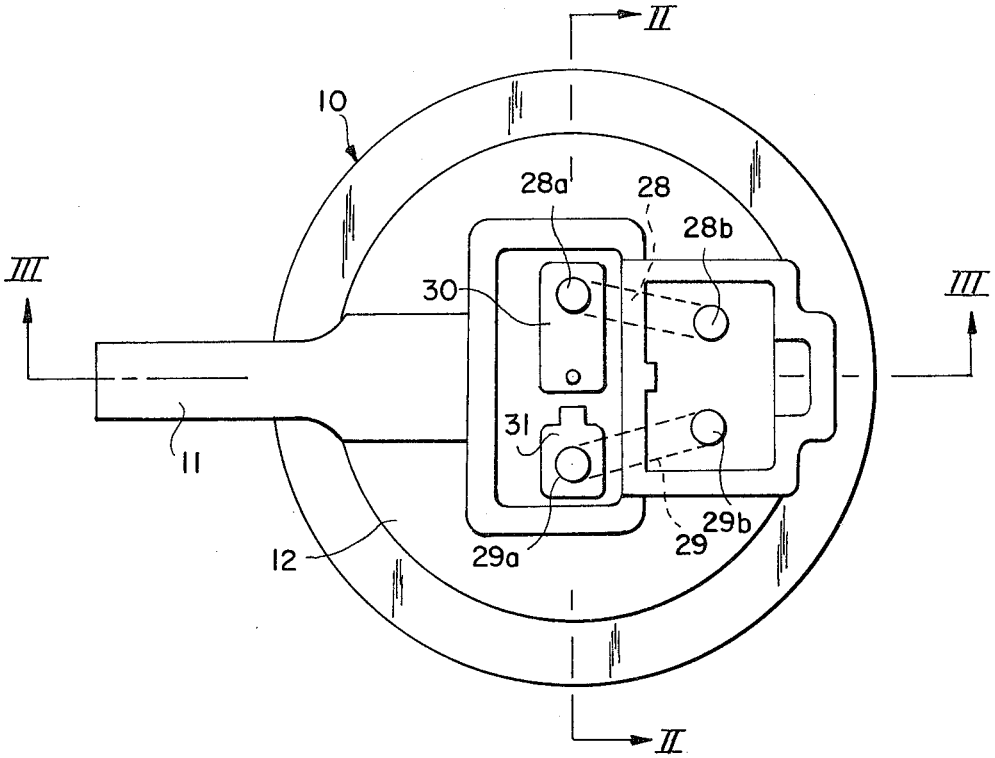
FIG. 4 is a front elevational view of the second embodiment.

The other ends **28*b* and 29*b* of the connectors 28 and 29 are connectable to the terminals of a conventional connector 32, shown in FIG. 5**.

The connector 32 has female terminals 33 and 34 which engage the male terminals **28*b* and 29*b* for connecting the latter to provide an electric circuit with lead wires 35 and 36**.

Operation of this embodiment is substantially the same to the previous embodiment and is therefore omitted.

The latter embodiment has particular merit compared to the first embodiment, in which one end of each lead wire 22, and 23 is directly secured to the switch assembly, and it is difficult to secure the flexible lead wires to the switch assembly because positioning the wires relative to the contacts of reed switch requires a severe tolerance in view of the sensitive operation thereof.

In the second embodiment, the two connectors 28 and 29 are firmly secured to the casing member 12 and are utilized as terminals which are easily connected to the leads 35 and 36 by the male terminals **28*b* and 29*b* through connector 32**.

Although the present invention has been described with reference to the two embodiments shown it will be understood that various modifications and variations may be employed within the scope of the claims appended thereto.

We claim:

1. A pressure differential switch device comprising a casing, a flexible movable annular diaphragm fixedly mounted about its periphery in said casing to divide said casing into a first chamber and a second chamber, means for admitting fluid pressures into said chambers for moving said diaphragm, a cylindrical member closed at one end and open at the opposed end and mounted axially in the center of said annular diaphragm for movement therewith, stop means within the first chamber of said casing for limiting axial movement of said diaphragm, a permanent annular magnet mounted on the outer wall of said cylindrical member for movement therewith, a reed switch assembly mounted within said cylindrical member, one end of said reed switch assembly passing through the open end of said cylindrical member and being secured to said casing and means for connecting the contacts of said reed switch assembly to lead wires, wherein said means for connecting the contacts of said reed switch assembly to lead wires includes a pair of U-shaped connectors, the intermediate portions of each being securely mounted in said casing, one end of each U-shaped connector being operatively connected to the respective contacts of said reed switch assembly and the other end of each U-shaped connector being disposed for receiving a conventional detachable female plug for connection to said lead wires, whereby when the pressure in said second chamber exceeds that in said first chamber by a predetermined amount said magnet will be moved by said cylindrical member in response to movement of said diaphragm in one direction to a first position in which the magnetic field of said magnet will close the contacts of said reed switch assembly, the movement of said diaphragm being limited by said stop means in said first chamber to prevent continued movement of said magnet in said direction beyond the first position.

2. A switch device as claimed in claim 1 and further comprising a metal capsule-like member fixed to said casing and projecting into said cylindrical member for receiving said reed switch assembly, one contact of said switch assembly being connected to one end of said capsule-like member and the other end of said capsule-like member being connected to a lead wire.

3. A switch device as claimed in claim 1 wherein said cylindrical member is provided with an outer central flange thereabout and further comprising a biasing means in the first chamber engaging said flange for biasing said cylindrical member and magnet into an inoperative position when the pressure differential in said two chambers is below a predetermined value.

4. A switch device as claimed in claim 3 and further comprising means for adjusting the force of said biasing means to regulate the predetermined pressure differential at which the magnet will be moved to close said reed switch assembly.

5. A device as claimed in claim 1 and further comprising a hollow projection formed integrally with said casing and disposed within said cylindrical member and wherein said reed switch assembly is mounted in said hollow projection.

* * * * *